US009169644B2

(12) United States Patent
Conterno

(10) Patent No.: US 9,169,644 B2
(45) Date of Patent: Oct. 27, 2015

(54) TRANSPARENT STRUCTURAL ELEMENT FOR COVERS

(71) Applicant: KOSCON INDUSTRIAL S.A., Stabio (CH)

(72) Inventor: Cosimo Conterno, Mendrisio (CH)

(73) Assignee: KOSCON INDUSTRIAL S.A., Stabio (CH)

( * ) Notice: Subject to any disclaimer, the term of this patent is extended or adjusted under 35 U.S.C. 154(b) by 0 days.

(21) Appl. No.: 13/888,650

(22) Filed: May 7, 2013

(65) Prior Publication Data

US 2013/0298486 A1 Nov. 14, 2013

(30) Foreign Application Priority Data

May 8, 2012 (IT) ..... MI2012A0771

(51) Int. Cl.
*E04C 1/00* (2006.01)
*E04C 2/20* (2006.01)
*E04D 3/28* (2006.01)

(52) U.S. Cl.
CPC .... *E04C 2/20* (2013.01); *E04D 3/28* (2013.01)

(58) Field of Classification Search
CPC ..... E04C 2/20; E04C 2/32; E04C 2/322; E04C 2/328; E04C 2002/004; E04C 2002/3466; E04C 3/28
USPC ..... 52/81.5, 309.1, 309.6, 537, 588.1, 630, 52/DIG. 17
See application file for complete search history.

(56) References Cited

U.S. PATENT DOCUMENTS

| | | | | |
|---|---|---|---|---|
| 2,644,777 | A * | 7/1953 | Havens | 428/116 |
| 4,791,773 | A * | 12/1988 | Taylor | 52/786.13 |
| 5,057,384 | A * | 10/1991 | Bones et al. | 429/104 |
| 6,241,098 | B1 * | 6/2001 | Schulte et al. | 209/401 |
| 6,615,555 | B2 * | 9/2003 | Madden | 52/202 |
| 2005/0138879 | A1 * | 6/2005 | Snel | 52/506.01 |
| 2010/0126093 | A1 * | 5/2010 | Davis et al. | 52/283 |

FOREIGN PATENT DOCUMENTS

| | | |
|---|---|---|
| CN | 2531006 Y | 1/2003 |
| DE | 2824759 | 12/1979 |
| DE | 3016241 | 10/1981 |
| EP | 0158951 | 10/1985 |
| GB | 2453150 | 4/2009 |

* cited by examiner

*Primary Examiner* — Patrick Maestri
(74) *Attorney, Agent, or Firm* — Modiano & Associati; Daniel J. O'Byrne

(57) ABSTRACT

A transparent structural element for covers extruded in a synthetic thermoplastic material includes two or more horizontal sheets parallel to each other and shaped to form a corrugated profile, wherein the two or more sheets are spaced and connected by a plurality of ribs having an undulating trend, the ribs having an undulating trend being present in both flat parts of the corrugated section and in tilted connection parts between the flat parts. In one embodiment, the transparent structural element for covers is made of polycarbonate (PC) or polymethylmethacrylate (PMMA).

5 Claims, 4 Drawing Sheets

TRANSPARENT STRUCTURAL ELEMENT FOR COVERS

FIELD OF THE INVENTION

The present invention relates to a transparent structural element, in particular for covers.

BACKGROUND OF THE INVENTION

In the construction of industrial warehouses, roofs of buildings, etc., structural elements are often used which ensure a certain safety for loads and allow great facility of use. A type which has been widely used for some time consists of corrugated sheets, which however have now become outdated due to the perishable nature of the metallic materials of which they are made.

Corrugated multiwall sheets made of a transparent plastic material having straight septa are currently widely used in substitution of or combined with these known sheets, which, contrary to the metallic corrugated sheets formerly used, allow the passage of light. For example, DE 2824759 discloses extruded sheets made of a plastic material.

These known corrugated multiwall sheets made of a plastic material, however, do not have the possibility of sustaining heavy loads, as their structure and characteristics are strictly associated with plastic materials.

It should also be noted that in some cases one must be able to intervene on already existing structures, such as those consisting of metallic corrugated sheets, in order to replace those that have deteriorated or even create a series of openings in the whole structure that allow the passage of light in the underlying environments.

In any case, it is certainly evident that for reasons of safety, these structural elements that are used in substitution, must also have the mechanical resistance requisites necessary for the purpose. They must in fact be efficient as they will form a part of an existing structure which, when finished, must in any case be relatively sturdy, at least with respect to loads.

In the case of a horizontal covering surface, for example, these transparent structural elements must have a high resistance to compression so that they do not become deformed if an unexpected load is deposited on them, such as a certain quantity of snow.

A solution to this requirement can be found in flat sheet-like elements made of solid glass, dimensioned so as to guarantee adequate mechanical performances and at the same time allow the passage of light.

It should be noted however that, due to the above dimensioning and performances required, the glass sheets are often heavy and therefore difficult to move and install.

Furthermore, flat panels such as those described in EP 1 543 945, have also been proposed by the same applicant, which, however, as it is known, specifically as a result of their completely flat form, have limited capacities.

In addition, it is also required to confer a certain aesthetic significance to structures of this type, particularly if created ex novo.

SUMMARY OF THE INVENTION

An objective of the present invention is therefore to provide a transparent or translucent structural element, in particular for covers, capable of solving the above drawbacks of the known art in an extremely simple, economical and particularly functional manner.

A further objective of the present invention is to provide a transparent or translucent structural element for covers, having high mechanical performances and also allowing the passage of light.

Another objective of the present invention is to provide a transparent or translucent structural element for covers, which is much lighter than the common solid glass sheets having the same mechanical characteristics.

Yet another objective of the present invention is to provide a transparent or translucent structural element for covers, which can be easily inserted in combination with metallic corrugated covers where there is the necessity of creating inlet points for light.

These objectives are achieved by providing a structural element for covers according to the present invention, as described in the following embodiments.

Further characteristics of the invention are indicated in the claims.

BRIEF DESCRIPTION OF THE DRAWINGS

The characteristics and advantages of a structural element for covers according to the present invention will appear more evident from the following illustrative and non-limiting description, referring to the enclosed schematic drawings, in which.

DETAILED DESCRIPTION OF EMBODIMENTS OF THE INVENTION

Figure 1:
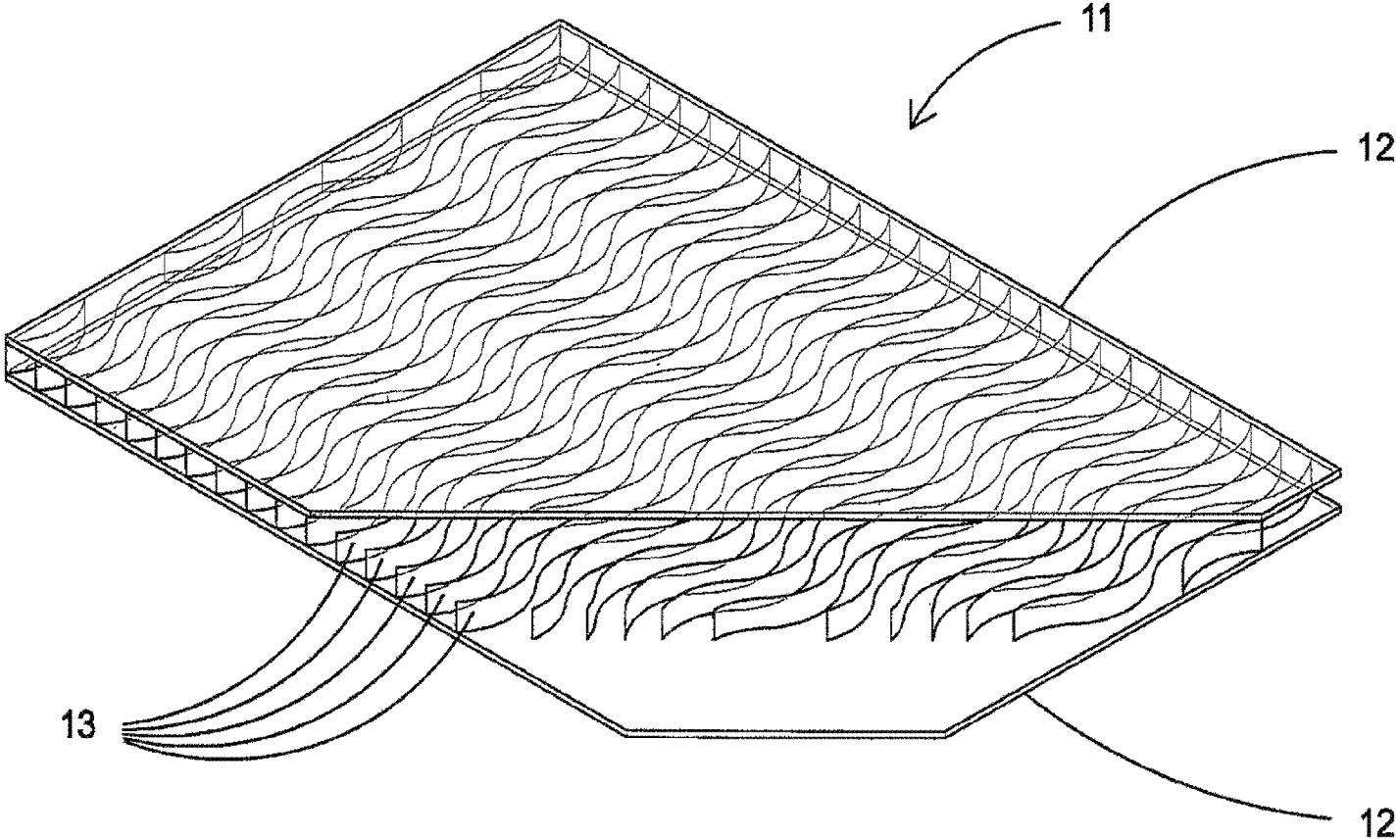
FIG. 1 is a partially cross-sectional perspective view of part of a transparent corrugated structural element for covers according to the present invention.
Figure 2:
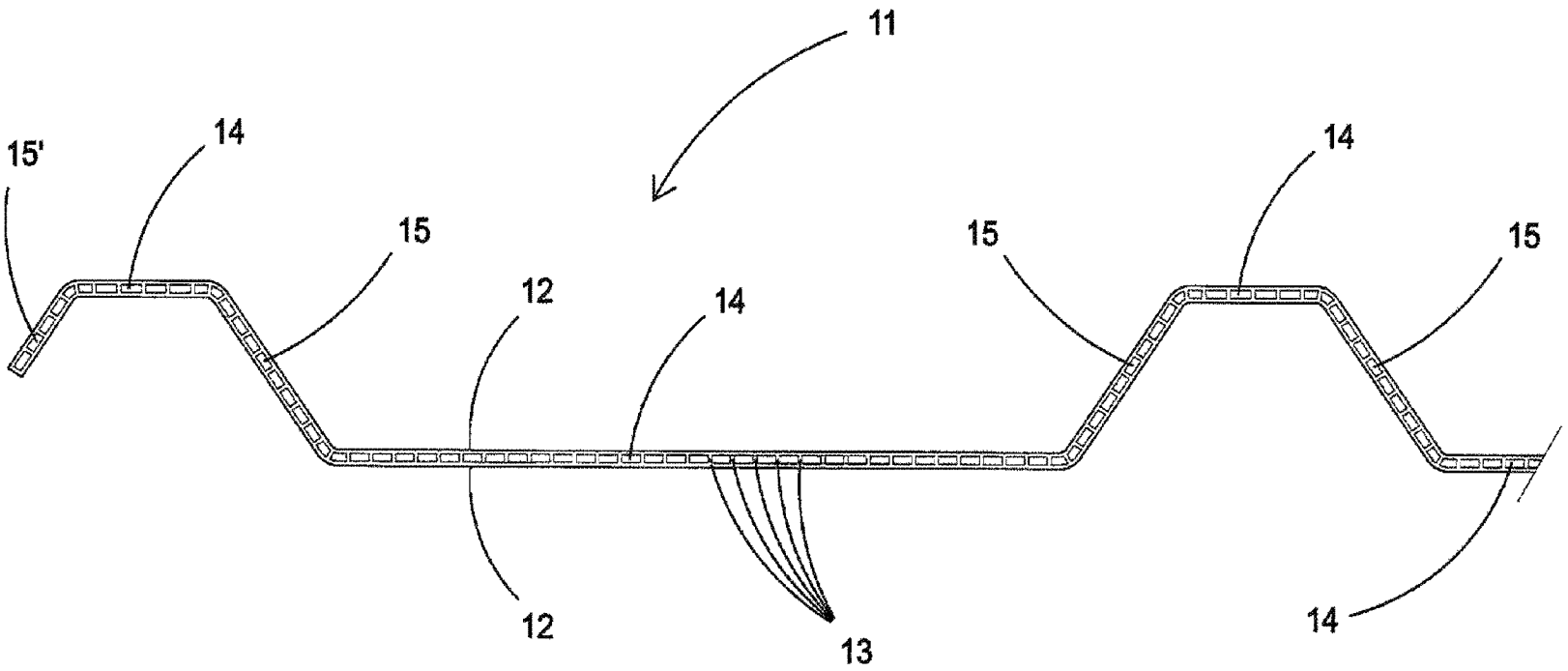
FIG. 2 is a front view of part of the element according to the invention.
Figure 3:
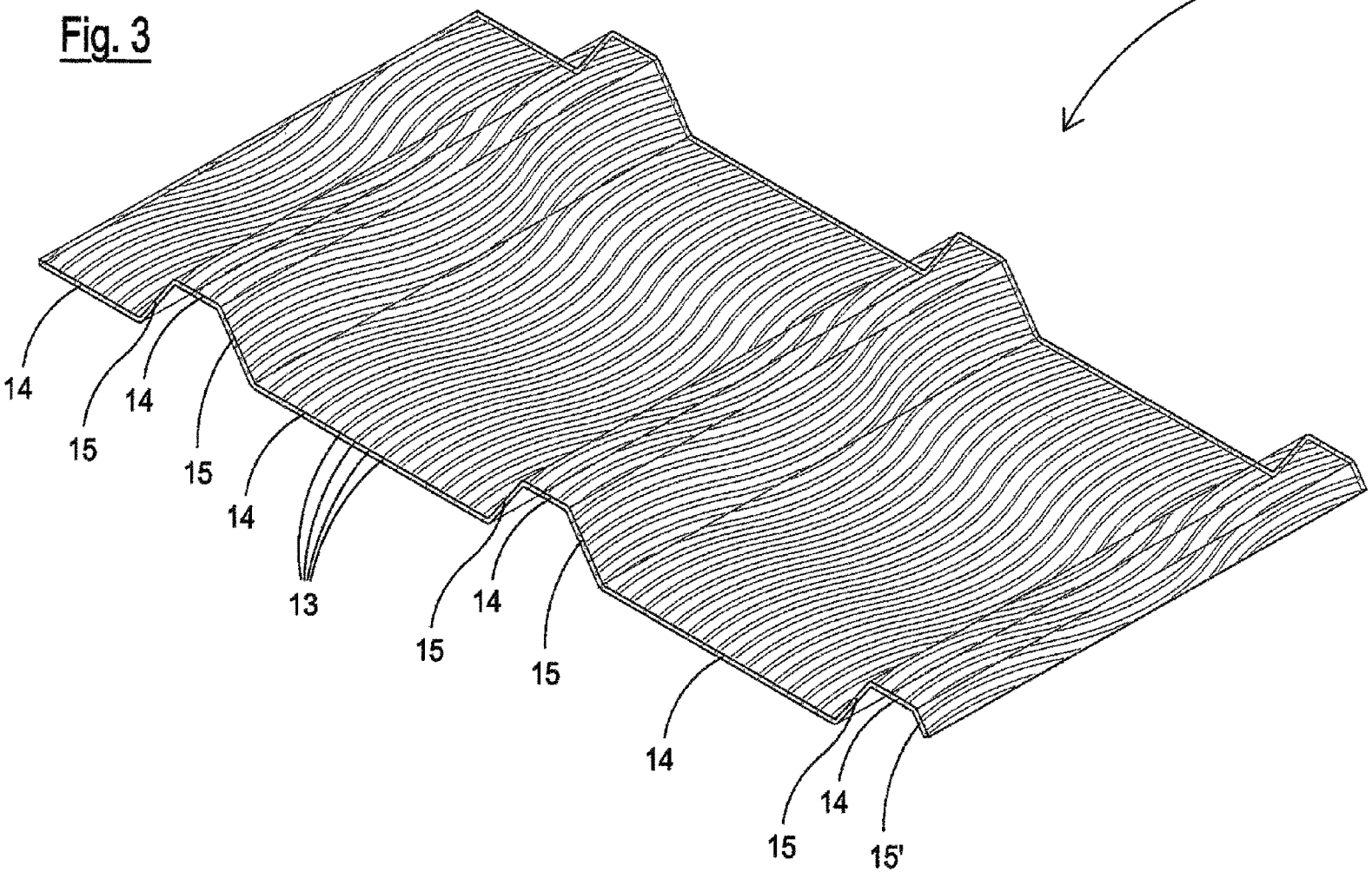
FIG. 3 is a perspective view of a transparent corrugated structural element for covers according to the present invention, partially shown.

The figures show an illustrative example of a transparent structural element, in particular for covers, according to the present invention, indicated as a whole with 11.

This transparent structural element is an extruded multiwall panel made of a synthetic thermoplastic material produced in a continuous single piece cut in the desired size. The multiwall material can be made of a transparent synthetic material.

It comprises two or more horizontal sheets 12 parallel to each other and shaped so as to create a corrugated section. The two or more sheets are spaced and connected by means of a plurality of ribs 13 having an undulating trend.

These ribs 13 have an undulating trend in both the flat parts 14 of the corrugation and also in the tilted connection parts 15 between the flat parts 14.

The raised figure shows how the flat parts 14 of the corrugation are, in the example, actually the larger and smaller bases of an isosceles trapezoid, whereas the tilted parts 15 are the oblique sides of the same.

The undulating conformation of the ribs 13 in both the flat parts 14 and tilted parts 15 give the transparent structural element 11 a desired level of rigidity and supporting capacity.

The reproduction of the outer form conformant with normal corrugated sheet is such that said transparent structural element can be arranged between existing corrugated sheets to create light points. In existing covers, an element according to the invention can even be positioned in substitution of an existing metallic corrugated sheet, creating an inlet for light.

This identical conformation is also such as to allow an adequate and perfect coupling of the transparent structural element with known corrugated sheets.

In alternative embodiments, as already mentioned, the transparent structural element 11 can consist of more than two sheets 12 forming various layers. These layers are all provided with ribs 13 having the above-mentioned undulating trend in both the flat parts 14 of the corrugation and also in the tilted connection parts 15 between the flat parts 14.

Figure 4:
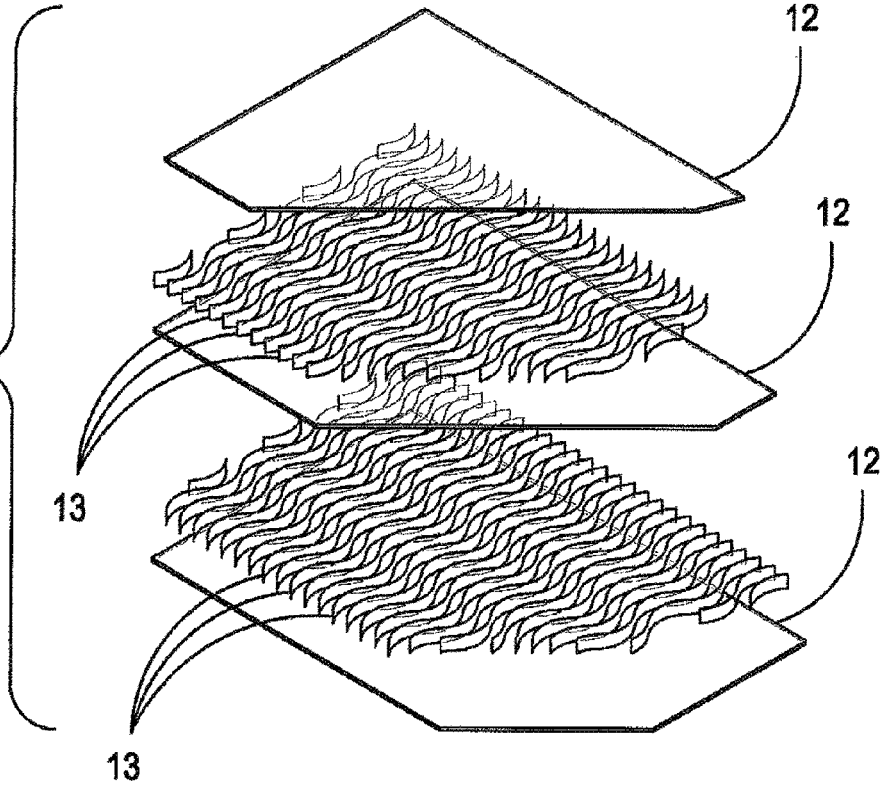
FIGS. 4 and 5 show further perspective views of a part of a further embodiment of a structural element according to the invention.
Figure 5:
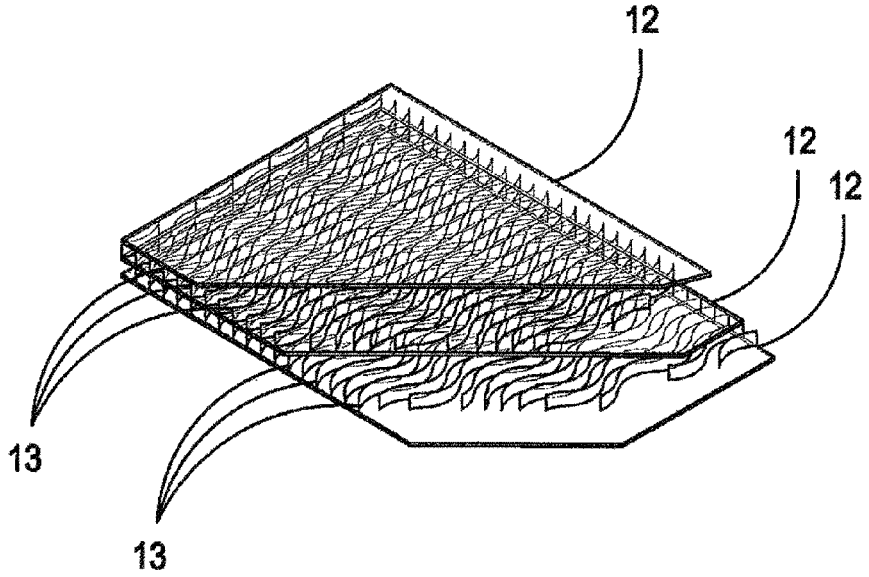

In a further alternative embodiment, the undulating ribs 13 forming a first layer can have an undulating longitudinal development different from the undulating longitudinal development envisaged in a second or other additional layer. The ribs can also be arranged offset with respect to those of the adjacent layer thus forming a structure having a greater resistance, even if it has a greater thickness with respect to that having a single layer (see FIGS. 4 and 5).

This product extruded in a single piece also provides a resistance comparable to that of metallic corrugated sheets with reduced thicknesses.

The transparent structural elements according to the present invention also have the advantage of being much lighter than normal plate sheets.

This facilitates their management and assembly between the parts.

The synthetic thermoplastic material used for producing the above elements is preferably polycarbonate, PC, or polymethylmethacrylate, PMMA.

It can thus be seen that a structural element for covers according to the present invention achieves the objectives previously specified.

In a preferred embodiment, the transparent structural element 11 has two shaped ends with a section such as an upper portion of an isosceles trapezoid and composed of a complete tilted part 15 connected to a complete flat part 14 and terminating with a short section of tilted part 15'.

Alternatively, but not necessarily, one end can be as described above and the other end of the transparent structural element 11, so that it is not symmetrical, only has a partial part 14 or total flat part of the corrugation. The end with the short section of tilted part 15' can be advantageously superimposed with respect to a complementary portion of a further transparent structural element 11 or a complementary end of a metallic corrugated sheet. In the other embodiment, the end with a similar flat part is positioned above or below complementary sections of a further transparent structural element 11 or a complementary end of a metallic corrugated sheet.

These elements in fact give resistance to external agents, whereas the internal polycarbonate sheet with a multiwall structure with ribs having a trend not defined by a single straight guideline provides a considerable resistance to compression, which contributes to lightening the whole structural element. It should be remembered that the resistance also mainly derives from the fact that the section of an element of this kind is corrugated with flat parts 14 of the corrugation connected by means of tilted parts 15.

The non-straight or undulating trend of the ribs is also envisaged in the tilted connection parts between the flat parts.

Advantageously, the transparent structural element according to the invention therefore offers high mechanical performances, it allows the passage of light and at the same time is much lighter than common corrugated sheets or sheets comprising solid glass parts used for the same purpose.

While the invention has been described in connection with the above described embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become obvious to those skilled in the art and the scope of the present invention is limited only by the appended claims.

The invention claimed is:

1. A transparent structural element for covers extruded in a synthetic material comprising:

two or more horizontal sheets parallel to each other and shaped to form a corrugated profile, wherein said two or more sheets are spaced and connected by a plurality of ribs having an undulating pattern, said ribs being provided both in flat parts of the corrugated profile and in tilted connection parts defined between the flat parts, said ribs having an undulating pattern with tangent planes that are orthogonal to said two or more horizontal sheets, wherein the transparent structural element has two shaped ends, at least one of said two shaped ends being shaped with a cross-section having an upper portion of an isosceles trapezoid in which a full tilted part is connected to a full flat part terminating with a shortened section of a tilted part, said ribs having an undulating pattern that is sinuosoidal and smooth.

2. The transparent structural element for covers according to claim 1, wherein said synthetic thermoplastic material is polycarbonate (PC) or polymethylmethacrylate (PMMA).

3. The transparent structural element for covers according to claim 1, wherein said corrugated profile is defined in a shape of an isosceles trapezoid.

4. A transparent structural element for covers extruded in a synthetic material comprising:

three or more horizontal sheets parallel to each other and shaped to form a corrugated profile, wherein said two or more sheets form corresponding layers and are spaced and connected by a plurality of ribs having an undulating pattern, said ribs being provided both in flat parts of the corrugated profile and in tilted connection parts defined between the flat parts, said ribs having an undulating pattern with tangent planes that are orthogonal to said two or more horizontal sheets, the ondulating ribs of a first layer of said layers having an undulating longitudinal development different from the undulating longitudinal development of an adjacent layer of said layers.

5. A transparent structural element for covers extruded in a synthetic material comprising:

three or more horizontal sheets parallel to each other and shaped to form a corrugated profile, wherein said two or more sheets form corresponding layers and are spaced and connected by a plurality of ribs having an undulating pattern, said ribs being provided both in flat parts of the corrugated profile and in tilted connection parts defined between the flat parts, said ribs having an undulating pattern with tangent planes that are orthogonal to said two or more horizontal sheets, the ondulating ribs of a first layer of said layers being offset with respect to undulating ribs of an adjacent layer of said layers.

* * * * *